United States Patent [19]

Miller

[11] 4,123,000

[45] Oct. 31, 1978

[54] METHOD OF STARTING A HOT AIR FURNACE

[75] Inventor: Robert F. Miller, Racine, Wis.

[73] Assignee: Modine Manufacturing Company, Racine, Wis.

[21] Appl. No.: 753,702

[22] Filed: Dec. 23, 1976

[51] Int. Cl.[2] ..... F26B 21/00

[52] U.S. Cl. ..... 236/11; 34/54

[58] Field of Search ..... 236/11, 49, DIG. 9; 34/54; 219/364, 400

[56] References Cited

U.S. PATENT DOCUMENTS

| | | | |
|---|---|---|---|
| 1,558,848 | 10/1925 | Doble, Jr. | 236/11 X |
| 2,038,578 | 4/1936 | Lamb | 236/11 X |
| 2,044,034 | 6/1936 | Watson et al. | 34/54 X |
| 2,291,145 | 7/1942 | Buck | 236/11 X |
| 2,329,636 | 9/1943 | McGrath | 236/11 X |
| 2,800,282 | 7/1957 | Calahan | 236/11 X |

*Primary Examiner*—William E. Wayner
*Assistant Examiner*—William E. Tapolcai, Jr.
*Attorney, Agent, or Firm*—Wegner, Stellman, McCord, Wiles & Wood

[57] ABSTRACT

An apparatus for starting a hot air recirculating furnace system. Reduced power is applied to the motor which drives the recirculating fan to cause the motor to turn at a reduced speed. The furnace is ignited during the application of the reduced power to the motor. As the temperature in the furnace increases, the warmer air recirculates and the load on the fan decreases. The power supplied to the fan motor is then increased, thereby increasing its speed as a function of the increased temperature as sensed by a thermostat in the furnace system. Full power is applied to the fan motor when the sensed temperature reaches a selected desired maximum. The apparatus and the method eliminate squeal of the belt which drives the fan and reduce wear common to those techniques which apply full voltage to the recirculating fan at furnace start-up. Also, this system reaches the desired operating temperature more quickly than prior art systems as a result of a reduced recirculating airflow during a longer acceleration period.

6 Claims, 2 Drawing Figures

FIG. 1
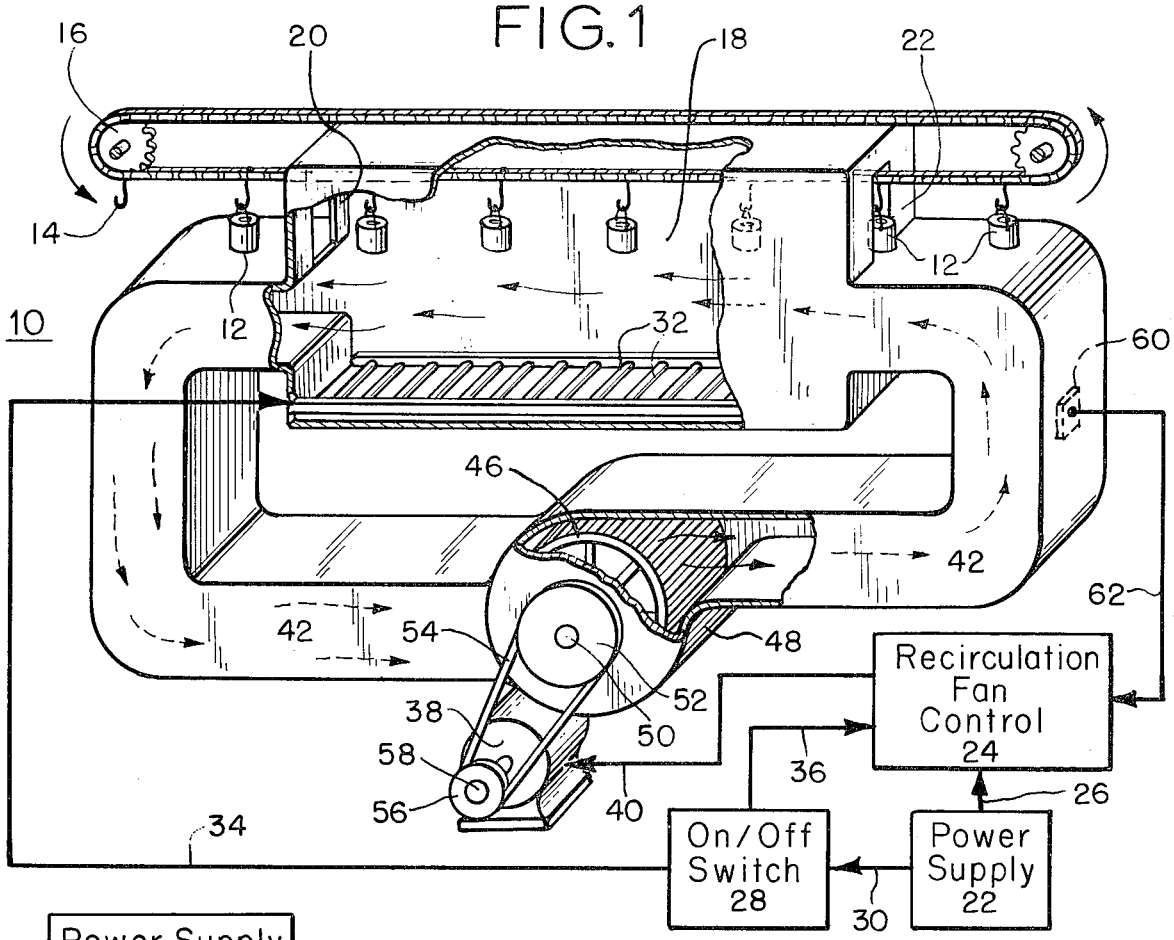
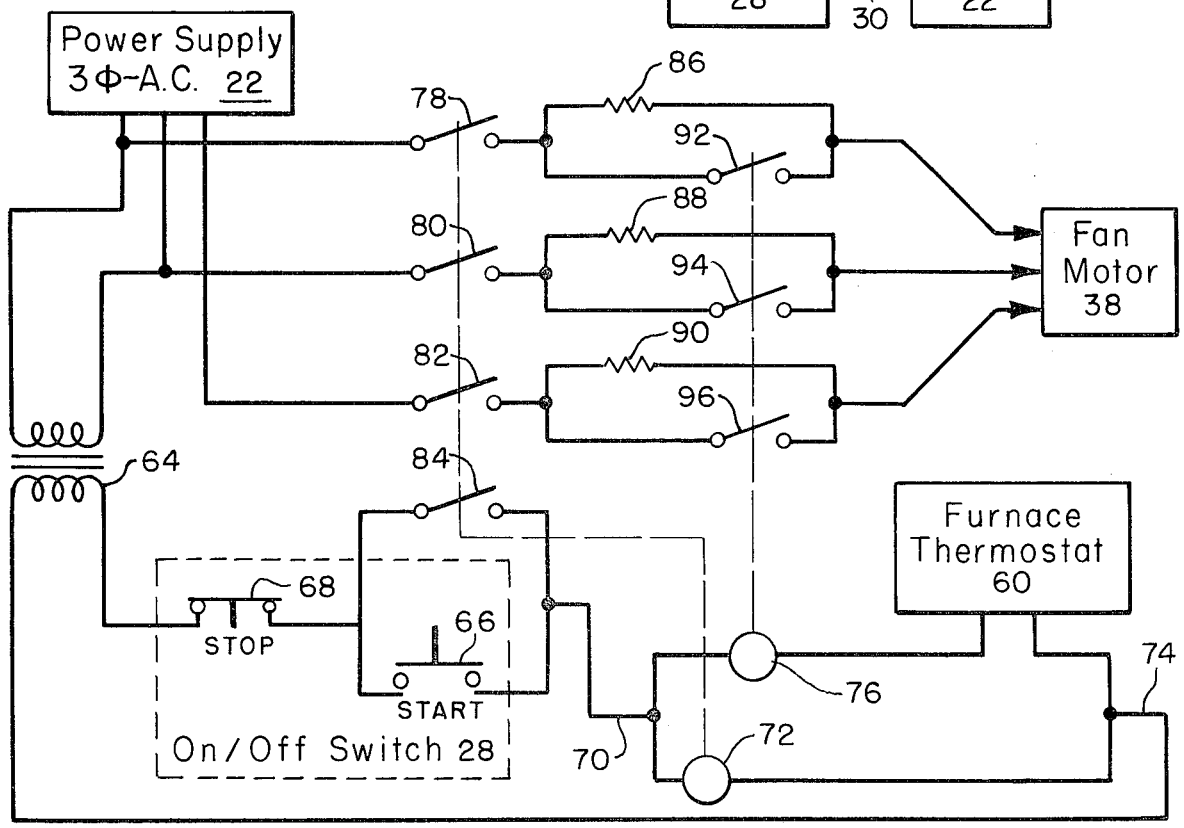
FIG. 2

METHOD OF STARTING A HOT AIR FURNACE

BACKGROUND OF THE INVENTION

This invention relates to an apparatus for starting a motor and a furnace and, more particularly, to a furnace recirculating fan starting system which obtains maximum efficiency of the fan motor as the temperature in the furnace increases.

Many commercial driers and heating systems have a furnace which elevates the ambient air to a suitable temperature for drying or heating. Usually such systems employ recirculating fans to continually reheat the furnace atmosphere and to maintain the desired temperature. When the system is first turned on and the furnace is ignited, the recirculating fan receives full power. Since air at lower temperatures is more dense than heated air, the motor which drives the fan is heavily loaded at start-up and the application of full voltage thereto causes belt squeal and other undesirable wear conditions which are common to full voltage starting techniques.

Another technique of starting a furnace system known to the prior art includes permitting a furnace to heat the air in the plenum to its desired temperature and then subsequently starting the recirculating fan when the temperature reaches that desired. This technique reduces the load on the fan motor since the air in the system is warmer, but requires an undesirably long start-up time resulting in delays and general inefficient operation.

Considering such drawbacks, I have developed an apparatus for starting a furnace and a recirculating fan motor which decreases wear on the motor and the linkage which drives the recirculating fan, and attains operating temperatures in a relatively short period of time.

SUMMARY OF THE INVENTION

Reduced power is applied to a motor which drives a recirculating fan in a furnace system simultaneously with the ignition of the furnace itself. As a result of the reduced voltage applied to the motor, the recirculating fan turns at a slower speed, resulting in a longer start-up period. However, as the air within the furnace system begins to increase in temperature, it becomes less dense. As the temperature of the air increases, more power is applied to the motor, thereby increasing the speed at which the system reaches its desired operating temperature.

A feature of the present invention is to provide a method of starting a motor for recirculating a furnace atmosphere in which reduced power is initially applied to the motor.

Another feature of the present invention is to provide a method of starting a furnace and its recirculating fan motor so that the furnace atmosphere is recirculated at a greater rate and in a manner proportional to the increase in air temperature.

Another feature of the present invention is to provide for less wear and tear on the belt or the drive train from the motor to the recirculating fan.

Yet another feature of the present invention is to increase the speed at which the system reaches its operating temperature by reducing the airflow during the longer start-up period.

Another feature of the present invention is to reduce the size requirement of the recirculating fan motor.

Other features of the present invention will become apparent when considering the specification in combination with the drawing in which:

BRIEF DESCRIPTION OF THE DRAWINGS

FIG. 1 depicts the recirculating hot air furnace in combination with a block diagram used to start the furnace and the recirculating fan motor; and FIG. 2 is a schematic of the recirculating fan control circuit shown in FIG. 1.

DESCRIPTION OF THE PREFERRED EMBODIMENT

Referring to FIG. 1, furnace system 10 is employed to provide for drying of articles 12 which are suspended from hooks 14 carried by conveyor 16. Although the furnace system 10 is shown to be operational with a conveyor carrying articles, it should be understood that the use of such furnace with any particular production line or drying system is well within the scope of this invention. For example, the drier could be used for grain which passes beneath it on a conveyor, a vehicle, or the like. However, for the purposes of explanation, the method is shown in combination with a system which provides for drying of articles hanging from hooks such as transformer cores or the like.

As the article 12 enters the plenum 18 by way of inlet 20, the heat within the plenum dries the article. After it has traversed the length thereof, the article 12 leaves the furnace system 10 by way of outlet 22. The article 12 is then removed from the hook 14 by an operator (not shown).

Power supply 22, generally a three-phased AC supply having appropriate circuit breakers to prevent overloads, provides power of sufficient magnitude to recirculating fan control circuit 24 by way of line 26. Although line 26 is shown in FIG. 1 as being a single electrical link or connection, it should be understood that the line 26 represents three-phased AC power if three-phased AC power is intended to be used. Power supply 22 also provides power to on/off switch 28 by way of line 30. On/off switch 28 is controlled manually by an operator or may be controlled from a remote location at a control panel or by a computer. The on/off switch 28 provides power to the heating element 32 of the furnace 18 by way of line 34 if the furnace is electrically powered or, alternatively, if the furnace is gas-controlled, on/off switch 28 provides a signal to the gas controls (not shown) to ignite the furnace when the switch is rendered conductive. The signal on line 36 from on/off switch 28 provides the signal to the recirculation fan control circuit 24 to start the recirculating fan motor 38. The power delivered to recirculating fan motor 38 is provided by way of line 40 which is shown as a single electrical link. However, if the recirculating fan motor 38 is a three-phased induction motor, the electrical link or line 40 would have three conductors. The power delivered to the recirculating fan motor 38 is provided by power supply 22 which, in turn, is controlled by the recirculation fan control 24.

When the on/off switch 28 is rendered conductive, a signal is provided on line 34 to ignite the heating element 32, as discussed above. At the same time, recirculation fan control circuit 24 provides a reduced power from power supply 22 to the recirculating fan motor 38. Air within the plenum 18 begins to heat and air within the system begins to recirculate. Fan 46 is mounted in fan housing 48 and moves the air from the duct 42 to the duct 44 in a circular motion in a manner consistent with the arrows showing the airflow in FIG. 1 (or in the opposite direction if so desired).

The fan 46 has a shaft 50 on which a pulley 52 is mounted. Belt 54 drives the pulley 52 at a speed which is sufficient to move the furnace atmosphere. Belt 54 is driven by a pulley 56 which is mounted on shaft 58 of the recirculating fan motor 38. Although the pulleys 52 and 56 are not shown to be of the same size in FIG. 1, it should be apparent that the relative size of the two pulleys depends upon the speed at which the motor operates, as well as the speed at which the fan is intended to operate.

As the air temperature within the furnace system 10 continually increases, recirculation fan control 24 applies greater power to the recirculating fan motor 38, thereby causing the fan 46 to turn within the fan housing 48 at a greater rate. Also, the load on the fan 46 lessens due to the warmer, less dense air. The thermostat is coupled to the recirculation fan control circuit 24 by way of line 62.

When the thermostat 60 senses a temperature equal to the desired operating temperature of the furnace system 10, the conveyor may be started and the articles 14 pass through the plenum 18. Also, when the desired operating temperature is reached, the power supply 22, as controlled by recirculating fan control 24, applies full power to the recirculating fan motor 38.

Referring to FIG. 2, the operation of the sequence of recirculation fan control will be described. Power supply 22 provides three-phased AC power for the fan motor 38. Transformer 64, coupled between any two of the three phases, is of a size sufficient to provide current for the control circuitry. For the purposes of explanation, the on/off switch 28 is shown having a start button 66 and a stop button 68. When it is desired to start the operation of the system, the start button 66 is depressed and current from the transformer 64 is provided on line 70. Current therefor is applied to relay or controller 72 and returned to the transformer 64 by the line 74. Current is not provided to relay or controller 76 since there is no return current path as a result of the furnace thermostat 60 being open-circuited. Specifically, furnace thermostat 60 remains as an open circuit until the temperature in the duct 42 reaches a certain preset temperature, at which point it becomes conductive.

Controller 72 is energized, thereby closing contacts 78, 80, 82 and 84. Contact 84 permits the bypass of the start button 66 to maintain the furnace system in its on condition. The closing of the contacts 78, 80 and 82 applies the three-phased AC power to the fan motor 38 through resistors 86, 88 and 90, respectively. The values of resistors 86, 88 and 90 are selected to provide approximately 80% of the voltage to the motor windings. Motor 38 then begins to turn, driving the fan 46. If no heat is present in the furnace, it will accelerate to approximately 65% synchronous speed. As the motor recirculates the air through the plenum 18 by way of ducts 42 and 44, the temperature in the system increases and the load on fan 46 decreases, thereby causing the fan 46 to accelerate slowly. As the temperature continues to increase and the load on the fan continues to decrease, the motor will reach approximately 80% of its synchronous speed. When the operating temperature of the furnace system 10 is reached, that condition is detected by the furnace thermostat 60, thereby providing current to relay or controller 76 by way of lines 70 and 74. Energization of the controller 76 closes the contacts 92, 94 and 96, thereby bypassing resistors 86, 88 and 90, respectively. When the resistors 86, 88 and 90 are bypassed, the full power from power supply 22 is provided to the fan motor 38. The full power provided to the fan motors 38 permits the motor to attain 100% of its synchronous speed as the temperature continues to increase throughout the system and the load lessens on the fan 46.

The above description of the operation of the circuit contemplates the use of discrete switching circuits such as relays which provide power to the motor 38 at selected temperature values. It should be obvious to those skilled in the art that in lieu of the discrete transitions from one step to another, one could use a phase-modulated controller to change the firing angle of a solid state AC motor starter circuit to apply a more evenly increasing voltage to the motor as the temperature approached its operating level. In such a case, furnace thermostat 60 would not be an on/off control, but rather a potentiometer in which the resistance is proportional to the temperature. Such a solid state AC motor starter is commercially available from Vectrol Inc. of Rockyville, Md, as a VMS solid state AC motor starter. Such solid state motor starter control device controls the starting cycle and provides for the reduced voltage to AC squirrel cage motors. In any event, the case of such an AC motor starter as a replacement for controllers 72 and 76 and their corresponding contacts is within the scope of the invention.

Finally, it should be noted that if the resistors 86, 88 and 90 are physically placed within plenum 18, the airflow through the plenum 18 tends to dissipate the heat generated by them during start-up. This heat advantageously contributes to the heat generated by the heating element 32 to further reduce the time required for the system to reach its operating temperature.

I claim:

1. In a hot air recirculating furnace system having a heating element and means for igniting the heating element, a thermostat, air ducts adapted to provide recirculating airflow, a three-phased inductor motor for driving a recirculating fan, a three-phased power supply for providing power to the motor comprising:

a first contact means coupled to each of the three phases of the power supply for providing current flow therethrough when closed;

resistive means coupled between the power supply and the motor for providing a current path from the power supply to the motor;

a second contact means coupled between the power supply and the motor for providing an alternate current path from the power supply to the motor;

a first controller means for controlling the opening and closing of the first contact means; and a second controller means responsive to the thermostat for controlling the current flow through the alternate current path.

2. The system as claimed in claim 1 further including:

a transformer coupled to two of the three phases of the power supply, said transformer having a first and a second lead;

an on/off control switch coupled to the first lead for causing the starting and stopping of the fan motor and for causing the starting and the stopping of the ignition of the furnace;

the first controller means coupled to the on/off switch, the second controller means also coupled to the on/off switch;

the thermostat coupled to the second controller means; and both the second controller and the thermostat connected to the second lead of the transformer.

3. The system as claimed in claim 1 wherein the resistive means are individual resistors capable of providing 80% of full load current from the power supply to the motor through the current path.

4. The system as claimed in claim 1 wherein the second controller means and the second contact means are the contacts of the relay.

5. The system as claimed in claim 1 wherein the second controller means and the second contact means is a solid state AC motor starter.

6. The system as claimed in claim 1 wherein the resistors are physically located in the heating ducts.

* * * * *